United States Patent [19]

Nakajima

[11] 4,044,573

[45] Aug. 30, 1977

[54] CAM MECHANISM FOR CIRCULAR KNITTING MACHINE

[75] Inventor: Yosiharu Nakajima, Itami, Japan

[73] Assignee: Okuma Machinery Works Ltd., Nagoya, Japan

[21] Appl. No.: 702,949

[22] Filed: July 6, 1976

[30] Foreign Application Priority Data

July 25, 1975 Japan ..... 50-103743[U]

[51] Int. Cl.[2] ..... D04B 15/32

[52] U.S. Cl. ..... 66/57

[58] Field of Search ..... 66/57, 78, 54, 38

[56] References Cited

U.S. PATENT DOCUMENTS

| | | | |
|---|---|---|---|
| 2,475,170 | 7/1949 | Zleve | 66/57 |
| 2,941,383 | 6/1960 | Mishcon et al. | 66/54 |
| 3,201,954 | 8/1965 | Greczin | 66/38 X |
| 3,257,828 | 6/1966 | Greczin | 66/38 |
| 3,421,344 | 1/1969 | Moyer et al. | 66/57 |
| 3,614,877 | 10/1971 | Radin | 66/54 X |
| 3,670,526 | 6/1972 | Martinetz | 66/57 |
| 3,848,432 | 11/1974 | Mishcon et al. | 66/54 |

FOREIGN PATENT DOCUMENTS

| | | | |
|---|---|---|---|
| 642,374 | 8/1950 | United Kingdom | 66/57 |

*Primary Examiner*—Mervin Stein
*Assistant Examiner*—Andrew M. Falik
*Attorney, Agent, or Firm*—Jay L. Chaskin

[57] ABSTRACT

A cam mechanism for a circular knitting machine includes stitch cams each of which is provided with main cam wall sections adapted to control the position of each descending needle after its operating butt has come into contact on its upper side with the one of the main cam wall sections. The stitch cam is also formed with auxiliary cam wall sections of substantially the same contours as the main ones for guiding the needle on the underside of either the same or another operating butt to permit smooth movement of the needle while the operating butt is being controlled by the main cam wall sections. The two cam wall sections cooperate to guide the needles without irregular motion of their butts or needle points.

4 Claims, 4 Drawing Figures

CAM MECHANISM FOR CIRCULAR KNITTING MACHINE

BACKGROUND OF THE INVENTION

1. Field of the Invention

This invention relates to a cam mechanism for a circular knitting machine, and more specifically to stitch cams of the mechanism which will stabilize the path of the points of knitting needles in the machine.

2. Description of the Prior Art

It has been often the case with circular knitting machines in operation that the butts of needles on their way from the clearing zones to the stitching or needle-lowering zones strike against the cam walls of the stitch cams, rebound from the walls, and then strike them again. The repetition of striking and rebounding can result in vertical oscillation, inclination, and other irregularities in needle motion, and hence instability in hook positions and adverse effects on knitting in rows of uniform loops. The irregular motion of the knitting needles has been a serious problem particularly for plaiting stitch because the yarns to form the knit and purl tend to be reversed to give knitted products of inferior quality.

BRIEF SUMMARY OF THE INVENTION

The present invention contemplates the provision of a cam mechanism for a circular knitting machine which will eliminate the foregoing disadvantages by means of stitch cams each of which is formed with main cam wall sections adapted to control the position of each descending needle after its operating butt has come into contact on its upper side with one of the main cam wall sections, and also formed with auxiliary cam wall sections of substantially the same contours as the main sections which guide the needle on the underside of either the said or another operating butt to permit smooth movement of the needle while its operating butt is being controlled by the main cam wall sections, so that the two cam wall sections cooperate to avoid irregular motion of the operating butt or butts, or of the point, of each knitting needle.

DETAILED DESCRIPTION OF THE PREFERRED EMBODIMENTS

Figure 1:
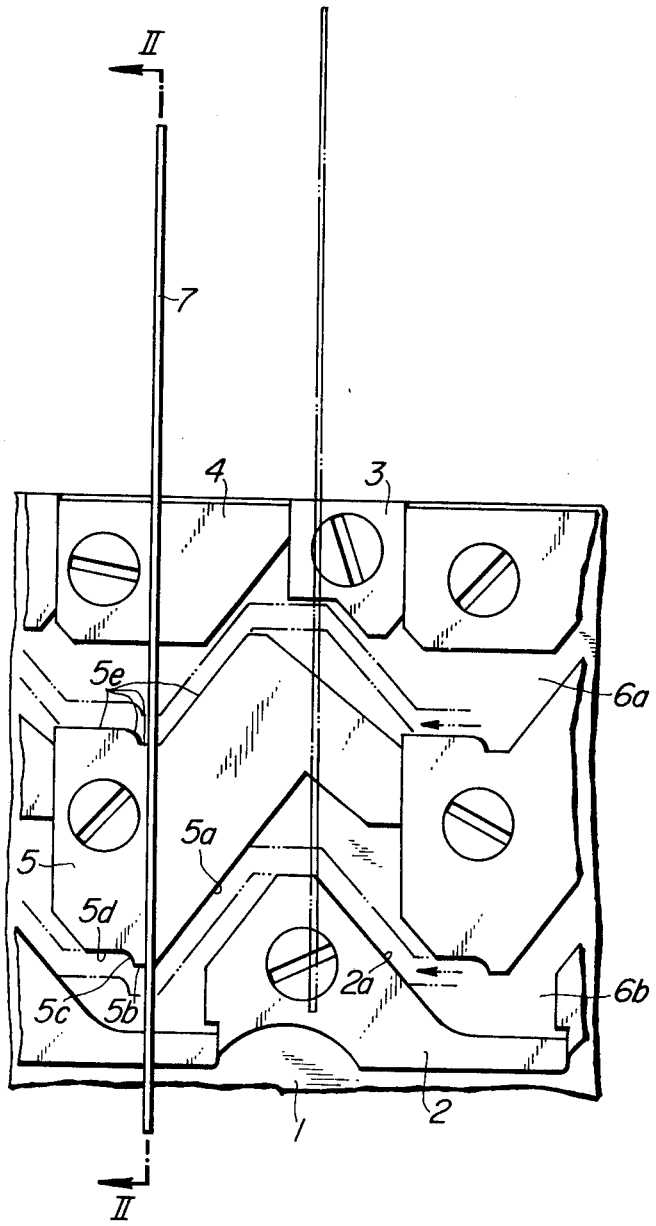
FIG. 1 is an inside view of the cam holder of a cam mechanism embodying the invention, as viewed from the cylinder side.
Figure 2:
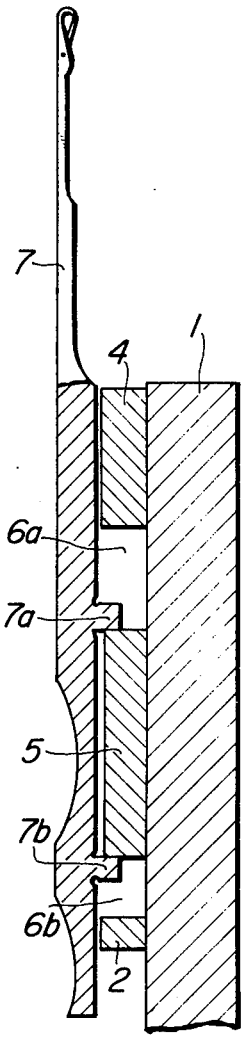
FIG. 2 is a sectional view taken on the line II—II of FIG. 1, showing the relationship between cams and butts of a needle.

Referring to the drawing, specifically to FIGS. 1 and 2 which show a cam mechanism embodying the invention, a cylindrical cam holder of a circular knitting machine is generally indicated at 1, with a series of raising cams 2 connected end to end in a circular arrangement and secured to the inner lower part of the cam holder, in such a manner that each raising cam 2, in the raising zone, can be in sliding contact with the underside of the lower operating butt *7a* of each knitting needle 7 to be described later. Guard cams 3 and guide cams 4, each of which is adapted to contact the upper side of the upper operating butt *7a* of each needle in the clearing zone that follows the raising zone, are alternately connected end to end in a circular arrangement and secured to the inner upper part of the cam holder 1. To the inner center part of the cam holder are fastened stitch cams 5 connected end to end in a circular arrangement so that the upper side of the lower operating butt *7b* and the under side of the upper operating butt *7a* of each needle can contact each of the stitch cams 5 in the stitch zone after the clearing zone. The stitch cams 5 are slidingly shiftable somewhat upward and downward to adjust the stitch dimensions. The guard cams 3, guide cams 4, and stitch cams 5 combinedly form an upper track *6a* in zigzag fashion, while the stitch cam 5 and raising cams 2 define a lower zigzag track *6b*. Into these tracks *6a*, *6b* are fitted, respectively, the upper and lower operating butts *7a*, *7b* of the knitting needles 7 which, in turn, are mounted in a number of vertical grooves cut in the knitting cylinder. Each of the raising cams 2 includes a needle-raising cam wall section *2a* ascending leftwardly as viewed in FIG. 1 so as to be in sliding contact with the underside of the lower operating butt *7b* of each needle 7 and to force the needle upward with the revolution of the knitting cylinder. On the underside of each stitch cam 5 facing the lower track *6b* is formed a needle-lowering cam wall section *5a* declining leftwardly as shown to be in sliding contact with the upper side of the lower operating butt *7b* of each needle thereby to lower the same. Ahead of the needle-lowering cam wall section *5a* are formed successively a tread cam wall section *5b*, a relief cam wall section *5c* for roving-back, and a needle-pressing cam wall section *5d*, in the advancing order as shown. These cam wall sections *5a* through *5d* represent the main cam wall sections which regulate the needle positions during stitching. On the opposite side of each stitch cam 5 that faces the upper track *6a* are formed auxiliary cam wall sections *5e* of substantially the same contours as the main cam wall sections to guide the upper operating butt *7a* of each needle on its underside so as to permit smooth movement of the needle while its lower but *7b* is in sliding contact with any of the main cam wall sections. The spacing between the underside of the upper operating butt *7a* and the auxiliary cam wall sections as determined in the direction of vertical movement of each knitting needle 7 is designed to be small enough to ensure smooth running of the needle without any inclination or irregular motion and corresponding to the knitting speed of the machine.

The operation of the cam mechanism according to the invention will now be described. As the knitting cylinder (not shown) revolves and each of the knitting needles 7 moves in the directions of arrows in FIG. 1, the underside of the lower operating butt *7b* at the starting point of the raising zone comes into sliding contact with the needle-raising cam wall section *2a* so that the needle 7 begins to raise. During its ascent the latch of the needle 7 is opened by a loop and the hook is fed with yarn. At the end of the ascent the lower operating butt *7b* is released from the needle-raising cam wall section *2a*, and the needle under protection by the guard cam 3 moves horizontally through the clearing zone. Further turning of the cylinder brings the lower operating butt *7b* to the starting point of the stitch zone where the upper side of the butt *7b* strikes against the main cam wall section, i.e., the needle-lowering cam wall section *5a*, of the stitch cam 5. The reaction tends to force the butt *7b* away from the main cam wall section, but the underside of the upper operating butt *7a,* in turn, is kept in sliding contact with the corresponding one of the auxiliary cam wall sections 5*e,* thus preventing the lower operating butt *7b* from being liberated from any part of the main cam wall sections. As described, the operating butts of each needle 7 are controlled in motion by the main and auxiliary cam wall sections, and move through the tracks in sliding contact with the main cam wall sections without the possibility of any unintended irregular motion. During the downward movement of the lower operating butt *7b* along the main cam wall section of the stitch cam 5, the hook and latch of the needle cooperate to form a loop. As the cylinder revolves further, tension imparted to the yarn by the roving-back phenomenon pulls the needle 7 upward. Consequently, the lower operating butt *7b* travels in sliding contact with the main cam wall sections of the stitch cam 5, i.e., the tread cam wall section 5*b,* relief cam wall section 5*c* for roving-back, and needle-pressing cam wall section 5*d,* in the order mentioned. Then, the lower operating butt leaves the stitch cam into sliding contact with the next raising cam. Throughout this period of transfer, the both upper and lower butts of the needle are guided by the main and auxiliary cam wall sections as stably as in the descent, and are smoothly shifted to the next zone without any irregular motion of the needle.

Figure 3:
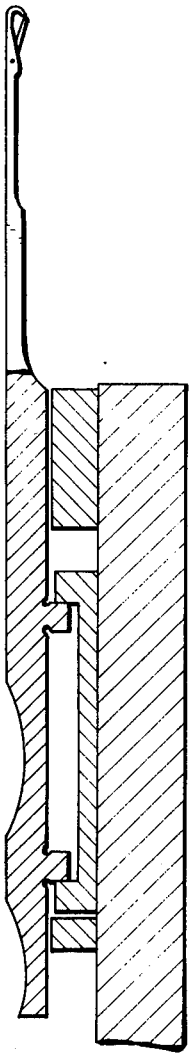
FIGS. 3 and 4 are views similar to FIG. 2 but showing the relationships between the corresponding components of other embodiments.
Figure 4:
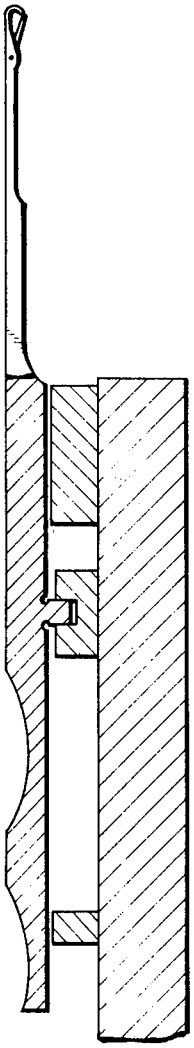

While the main and auxiliary cam wallsections in the embodiment have been described as provided on opposite sides of the stitch cam, they may be shifted in relative position as shown in FIG. 3 to obtain equally satisfactory results. In a further modification, the main and auxiliary cam wall sections may take the form of both sides of a groove as in FIG. 4, in which case the needle may have only one operating butt instead of two as in the preceding embodiments.

According to the present invention, as described in detail, each stitch cam 5 is formed with main cam wall sections adapted to control the position of each descending needle 7 after its operating butt has come into contact on its upper side with one of the main cam wall sections, and is also formed with auxiliary cam wall sections of substantially the same contours as the main sections for guiding the needle on the underside of either the same or another operating butt to permit smooth movement of the needle while its operating butt is being controlled by the main cam wall sections, so that the two cam wall sections cooperate to avoid irregular motion of the operating butt or butts, or of the point, of the knitting needle. In this way the yarn is smoothly picked up to form uniform loops, even in plaiting stitch. Moreover, the stability of needle motion permits high-speed knitting operation to a great advantage.

It will be obvious to those skilled in the art that the principles of this invention are even more advantageously applicable to sinker cams.

What is claimed is:

1. A cam mechanism for a circular knitting machine including stitch cams and double butt needles wherein each of said stitch cams is disposed inside or between a pair of fixed operating butts of each double-butt needle and is provided with main cam wall sections on its under side adapted to control the position of each double-butt needle while causing descending motion thereof after one of its operating butts has come into contact on its upper side with one of said main cam wall sections so that knitting operation is effected thereby, and each of said stitch cams is also provided with auxiliary cam wall sections on its upper side of substantially the same contours as said main cam wall sections for guiding the needle on the under side of the other operating butt to permit smooth movement of said each needle while said one operating butt is being controlled by said main cam wall sections, whereby said main cam wall sections and said auxiliary cam wall sections are brought into contact with the inner sides of the respective operating butts to minimize irregular motion of said each needle during knitting operation.

2. The cam mechanism of claim 1 wherein each of said stitch cams is mounted on a cam support so as to allow adjustment of its position thereon.

3. A cam mechanism for a circular knitting machine including stitch cams and double butt needles wherein each of said stitch cams is disposed outside a pair of fixed operating butts of each double-butt needle and is provided with main cam wall sections on its upper inner side adapted to control the position of each double-butt needle while causing descending motion thereof after one of its operating butts has come into contact on its upper side with one of said main cam wall sections so that knitting operation is effected thereby, and each of said stitch cams is also provided with auxiliary cam wall sections on its under inner side of substantially the same contours as said main cam wall sections for guiding the needle on the under side of the other operating butt to permit smooth movement of said each needle while said one operating butt is being controlled by said main cam wall sections, whereby said main cam wall sections and said auxiliary cam wall sections are brought into contact with the outer sides of the respective operating butts to minimize irregular motion of said each needle during knitting operation.

4. The cam mechanism of claim 3 wherein each of said stitch cams is mounted on a cam support so as to allow adjustment of its position thereon.

* * * * *